US009808393B2

(12) United States Patent
Varghese et al.

(10) Patent No.: US 9,808,393 B2
(45) Date of Patent: Nov. 7, 2017

(54) MOBILITY AIDS AND RELATED METHODS

(71) Applicant: BETTER WALK, INC., Atlanta, GA (US)

(72) Inventors: Andrew Varghese, Suwanee, GA (US); Partha Unnava, Atlanta, GA (US); Franklin Swindell, Grayslake, IL (US)

(73) Assignee: BETTER WALK, INC., Atlanta, GA (US)

( * ) Notice: Subject to any disclaimer, the term of this patent is extended or adjusted under 35 U.S.C. 154(b) by 0 days.

(21) Appl. No.: 14/900,477

(22) PCT Filed: Jun. 27, 2014

(86) PCT No.: PCT/US2014/044628
§ 371 (c)(1),
(2) Date: Dec. 21, 2015

(87) PCT Pub. No.: WO2014/210495
PCT Pub. Date: Dec. 31, 2014

(65) Prior Publication Data

US 2016/0151229 A1 Jun. 2, 2016

Related U.S. Application Data

(60) Provisional application No. 61/840,268, filed on Jun. 27, 2013, provisional application No. 61/916,532, filed on Dec. 16, 2013.

(51) Int. Cl.
*A61H 3/02* (2006.01)
*A61H 3/00* (2006.01)

(52) U.S. Cl.
CPC ..... *A61H 3/02* (2013.01); *A61H 2003/006* (2013.01); *A61H 2003/0216* (2013.01);
(Continued)

(58) Field of Classification Search
CPC ..... A61H 3/02; A61H 2003/006; A61H 2201/1635; A61H 2201/1628
(Continued)

(56) References Cited

U.S. PATENT DOCUMENTS 1,244,249 A * 10/1917 Schlick ..... A61F 2/60 135/71
2,552,902 A * 5/1951 Martin ..... A61H 3/02 135/73
(Continued)

FOREIGN PATENT DOCUMENTS

DE 29519273 U1 * 5/1996 ..... A61H 3/02
DE 102007031340 A1 1/2009
(Continued)

OTHER PUBLICATIONS

PCT/US2014/044628, "International Preliminary Report on Patentability," Jan. 7, 2016, 8 pages.
(Continued)

*Primary Examiner* — Noah Chandler Hawk

(57) ABSTRACT

A mobility aid is provided for use in supporting at least part of a user's body weight. The mobility aid generally includes a leg, a support configured to receive at least part of a forearm of a user's arm, a handle configured to be grasped by the user, and a force distribution member configured to engage a user's side and provide support to the user. The support extends away from the leg and is arranged at an angle with the leg of between about fifteen degrees and about forty-five degrees. The handle extends away from the leg and is arranged at an angle with the leg of between about fifteen degrees and about forty-five degrees. The force distribution member is pivotally coupled to the support such that the mobility aid can be used on either a right side or a left side of the user's body.

8 Claims, 14 Drawing Sheets

(52) U.S. Cl.
CPC ..... *A61H 2003/0227* (2013.01); *A61H 2003/0238* (2013.01); *A61H 2201/0192* (2013.01); *A61H 2201/1635* (2013.01)

(58) Field of Classification Search
USPC ..... 135/71, 72, 73, 68
See application file for complete search history.

(56) References Cited

U.S. PATENT DOCUMENTS

| | | | | | |
|---|---|---|---|---|---|
| 2,817,348 | A * | 12/1957 | Holliday, Jr. | A61H 3/02 | 135/69 |
| 3,174,494 | A * | 3/1965 | Maguire, Jr. | A61H 3/02 | 135/68 |
| 3,213,870 | A * | 10/1965 | Kiehn | A61H 3/02 | 135/68 |
| 3,304,946 | A * | 2/1967 | Lutes | A61H 3/02 | 135/69 |
| 4,763,680 | A * | 8/1988 | Acosta, Sr. | A61H 3/02 | 135/68 |
| 4,996,978 | A | 3/1991 | Gingras | | |
| 5,287,870 | A | 2/1994 | Rhodes | | |
| 5,329,954 | A | 7/1994 | Miyoshi | | |
| 5,458,143 | A | 10/1995 | Herr | | |
| 5,555,904 | A | 9/1996 | Stockwell | | |
| 5,564,451 | A | 10/1996 | Hagberg | | |
| 5,671,765 | A | 9/1997 | Hagberg | | |
| 5,711,334 | A * | 1/1998 | Roux | A61H 3/02 | 135/65 |
| 5,725,005 | A * | 3/1998 | Yamasaki | A61H 3/02 | 135/65 |
| 6,470,900 | B1 | 10/2002 | Hamilton | | |
| 8,474,470 | B2 | 7/2013 | Albertyn | | |
| 9,032,982 | B2 * | 5/2015 | Summit | A61H 3/02 | 135/68 |
| 9,289,346 | B2 * | 3/2016 | Demski | A61H 3/02 | |
| 2009/0114257 | A1 * | 5/2009 | Sutton | A61H 3/02 | 135/72 |
| 2009/0235966 | A1 * | 9/2009 | Birnbaum | A61H 3/0277 | 135/66 |
| 2011/0126872 | A1 | 6/2011 | Albertyn | | |
| 2011/0290290 | A1 | 12/2011 | Huang | | |
| 2012/0060879 | A1 | 3/2012 | Webb | | |
| 2012/0255589 | A1 | 10/2012 | Larson et al. | | |
| 2012/0318313 | A1 | 12/2012 | Dickerson, II | | |
| 2013/0180558 | A1 | 7/2013 | Weber et al. | | |

FOREIGN PATENT DOCUMENTS

| | | | | |
|---|---|---|---|---|
| FR | 2703246 | A1 * | 10/1994 | A61H 3/02 |
| FR | 2923379 | A1 | 5/2009 | |
| FR | 2923379 | B1 * | 2/2011 | A61H 3/02 |
| JP | H10216183 | A | 8/1998 | |
| JP | 2009268655 | A | 11/2009 | |
| KR | 1020110076418 | | 7/2011 | |
| WO | 01/21128 | A1 | 3/2001 | |
| WO | 2005041844 | A1 | 5/2005 | |
| WO | 2007027098 | A1 | 3/2007 | |

OTHER PUBLICATIONS

PCT/US2014/044628, "International Search Report and Written Opinion," Nov. 3, 2014, 12 pages.
SmartCRUTCH, Independent Living Centre, found online at http://www.ilcnsw.asn.au/items/9239, believed to be publicly available as early as Mar. 3, 2011
Slavens, et al., An upper extremity inverse dynamics model for pediatric Lofstrand crutch-assisted gait, Journal of Biomechanics, 44(11):2162-2167, Jul. 2011.
Robin, The Fulcrum Crutch Converts to Conform as Recovery Equipment, found online at http://www.trendhunter.com/trends/fulcrum-crutch, Jul. 13, 2012.
European Patent Application No. 14818463.3, extended European search report dated Dec. 14, 2016, 10 pages.

* cited by examiner

MOBILITY AIDS AND RELATED METHODS

Related Applications

This application claims the benefit of U.S. Provisional Patent Application No. 61/840,268, filed Jun. 27, 2013, and U.S. Provisional Patent Application No. 61/916,532, filed Dec. 16, 2013, the disclosures of which are incorporated herein by this reference in their entirety.

FIELD

The present disclosure generally relates to mobility aids and, more particularly, to mobility aids configured, for example, to support at least a portion of a users' body weight and/or transfer at least a portion of the users' body weight from their legs to their upper bodies, etc. to help improve mobility (e.g., walking movement, etc.) of the users.

BACKGROUND

This section provides background information related to the present disclosure which is not necessarily prior art.

Crutches are often used by people who cannot use their legs to assist with moving, walking, etc. Typically, the crutches are optimally configured to be positioned under the users' arms to thereby support the users' weight. The users can then pivot their lower bodies about the crutches to move, walk, etc.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

The present disclosure generally relates to mobility aids for use in supporting users. Optimally, the mobility aid generally includes a leg having a longitudinal axis, a support coupled to the leg for receiving at least part of a forearm portion of a user's arm during use of the mobility aid, and a handle coupled to the leg for grasping during use of the mobility aid. The support extends away from the leg and is arranged at an angle with the leg (e.g., an angle of between about fifteen degrees and about forty-five degrees, etc.). And, the handle extends away from the leg and is arranged at an angle with the leg (e.g., an angle of between about fifteen degrees and about forty-five degrees, etc.). Optimally, the support and the handle are ergonomically arranged at desired angles (e.g., angles ranging from about thirty degrees to about ninety degrees, angles less than about thirty degrees, angles greater than about ninety degrees, etc.), for example, to help inhibit stress on the user's wrists when using the mobility aid.

Optimally, the mobility aid generally includes a leg, a support extending away from the leg for receiving at least part of a forearm portion of a user's arm during use of the mobility aid, a handle extending away from the leg for grasping during use of the mobility aid, and a force distribution member for supporting the user during use of the mobility aid. The force distribution member is coupled to the support and is configured to engage a side portion of the user's body to help support the user during use of the mobility aid and/or to help properly align the user's body with the mobility aid. In some aspects of the present disclosure, the force distribution member is also adjustable, for example, such that the mobility aid can be used on either a right side of the user's body or a left side of the user's body, etc.

Further areas of applicability are apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

The subject matter of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
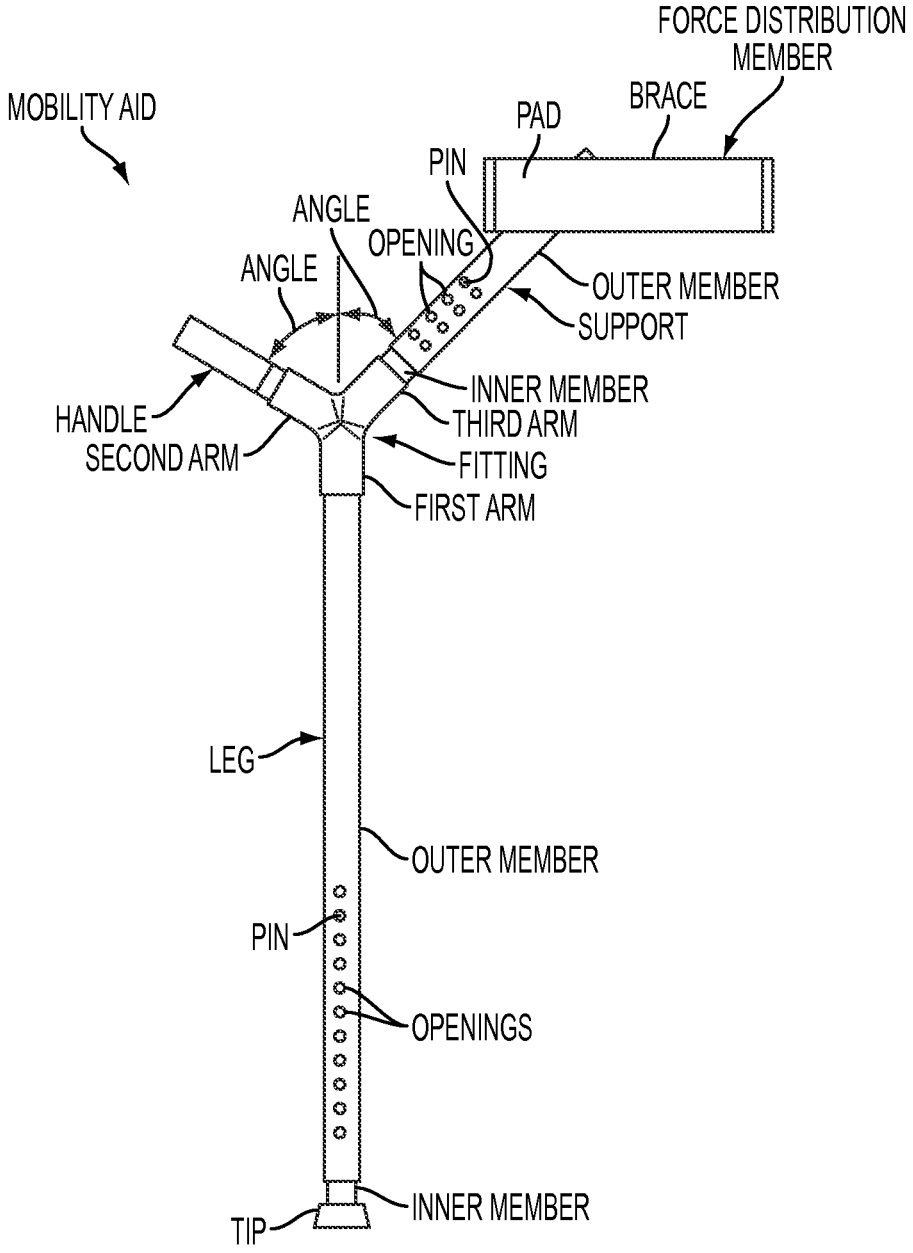
FIG. 1 is a side elevation view of an example embodiment of a mobility aid of the present disclosure.
Figure 2:
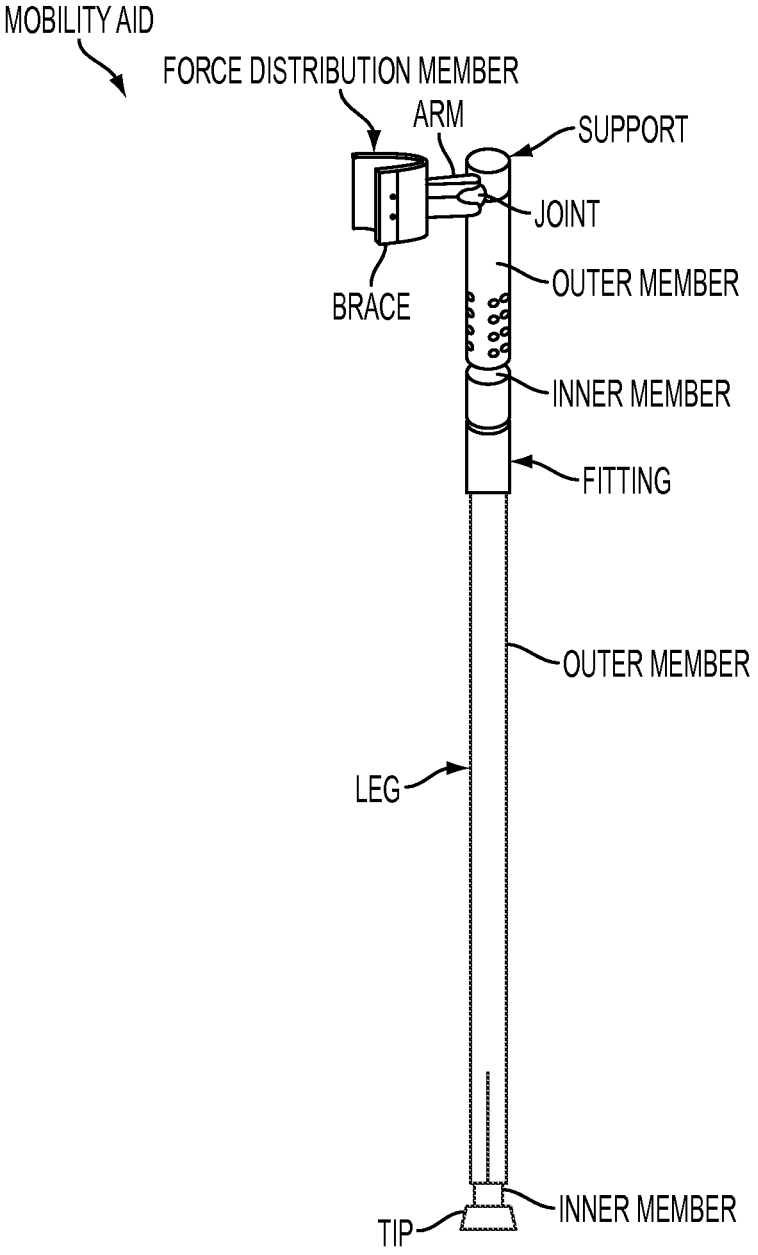
FIG. 2 is a rearward elevation view of the mobility aid of FIG. 1.
Figure 3:
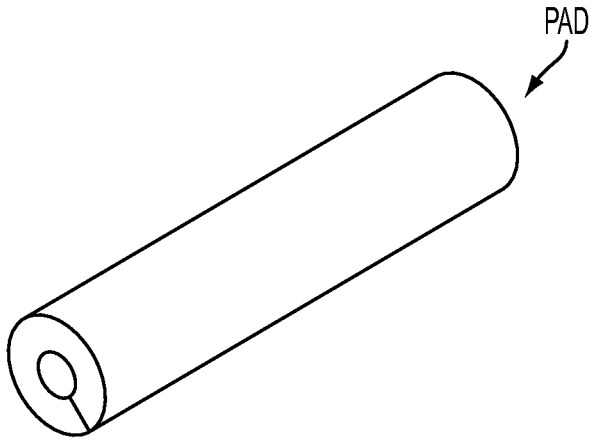
FIG. 3 is a perspective view of a pad for use with a support of the mobility aid of FIG. 1.

FIGS. 1-3 illustrate an example embodiment of a mobility aid according to the present disclosure. The mobility aid is configured to help a user, who may have mobility impairments, improve their mobility (e.g., their general movement, their ability to stand, their ability to walk, etc.). In particular, the mobility aid can be used to support at least a portion of the user's body weight and thereby transfer the weight off the user's leg or legs (e.g., transfer at least a portion of the user's body weight off the user's leg or legs to the mobility aid, transfer at least a portion of the user's body weight off the user's leg or legs to the users' upper body, combinations thereof, etc.). As such, the mobility aid can help the user to easily stand without stress on their legs, and to easily walk when desired.

As shown in FIGS. 1 and 2, the mobility aid generally includes a leg, a handle, a support, and a force distribution member. In general during use, the leg supports the mobility aid on a desired surface (e.g., a ground surface, a floor surface, etc.). The support is configured to receive at least part of a forearm portion of the user's arm in a position to grasp the handle. And, the force distribution member is configured to engage a user's side and provide support, stability, etc. to the user when standing, walking, etc. Additional description of an example use of the mobility aid will be provided in more detail hereinafter.

In the illustrated embodiment, the leg, the support, and the handle of the mobility aid are coupled together by a Y-shaped fitting. For example, the leg is coupled to a first arm of the fitting, the handle is coupled to a second arm of the fitting, and the support is coupled to a third arm of the fitting. As such, the illustrated mobility aid has a generally Y shape. In addition, it should be appreciated that the leg, the handle, the support, and the force distribution member may be constructed from any suitable material within the scope of the present disclosure including, for example, metals (e.g., steel, aluminum, titanium, alloys, etc.), plastics, padded materials, combinations thereof, etc.

With continued reference to FIGS. 1 and 2, the leg of the illustrated mobility aid includes an outer member and an inner member. The outer member is coupled to the first arm of the fitting, and the inner member is disposed partially within the outer member. A tip is coupled to a lower end portion (as viewed in FIGS. 1 and 2) (e.g., a distal end portion, etc.) of the inner member. The tip can be formed from suitable material (e.g., rubber, plastic, etc.) to, for example, provide impact cushioning to the mobility aid, increase traction between the mobility aid and the surface, combinations thereof, etc. In the illustrated embodiment, the outer member and the inner member of the leg are provided with a tubular construction. However, other constructions (e.g., constructions with generally square shaped cross sections, constructions with generally oval-shaped cross sections, etc.) could be used for the outer member and/or the inner member within the scope of the present disclosure.

As best shown in FIG. 1, the inner member of the leg is moveable relative to (e.g., slidable within, etc.) the outer member of the leg to allow for changing a length of the leg. A locking system is provided to hold, retain, etc. the inner member in a desired position relative to the outer member (and thereby secure the leg at a desired length). In particular, the inner member includes a spring-loaded pin configured to selectively position in one of a series of openings defined along the outer member. A spring (not visible) associated with the pin operates to hold the pin in the selected opening. When desired to change a length of the leg, the pin can be pressed radially inwardly against a bias of the spring and moved out of the current opening (and out of alignment with the series of openings), and the inner member can then be moved relative to the outer member to a new position. Once the inner member is at the desired position, the pin can be repositioned to align with the new opening corresponding to the new length of the leg, and the bias force of the spring then moves the pin into the opening (to secure the inner member relative to the outer member). As such, the leg can be adjusted to any one of multiple different lengths as desired. It should be appreciated that locking systems utilizing, for example, friction fittings, compression fittings, etc. could alternatively be used in the mobility aid (instead of spring loaded pins) within the scope of the present disclosure to hold, retain, etc. the inner member of the leg in a desired position relative to the outer member of the leg.

The handle of the illustrated mobility aid is located toward an upper end portion of the leg (as viewed in FIGS. 1 and 2), and extends generally radially away from the leg. In some aspects of the present disclosure, the handle may be covered, wrapped, coated, etc. with material (e.g., leather, cloth, etc.) to help improve comfort, grip, etc. when grasping the handle. In addition, in some aspects of the present disclosure, the handle may be molded to a general shape of a user's hand (e.g., the handle itself may be molded to a desired shape, a separate mold may be coupled over the handle, etc.) to help improve comfort, grip, etc. when grasping the handle.

In the illustrated embodiment, the handle extends away from the leg at an angle of about forty-five degrees relative to a longitudinal axis of the leg. In other example embodiments, mobility aids may include handles extending away from legs at angles (relative to longitudinal axes of the legs) ranging between about fifteen degrees and about forty-five degrees. In still other example embodiments, mobility aids may include handles extending away from legs (relative to longitudinal axes of the legs) at angles of less than about forty-five degrees, or at angles greater than about forty-five degrees.

The support of the illustrated mobility aid is also located toward an upper end portion of the leg (as viewed in FIGS. 1 and 2), generally opposite the handle, and extends generally radially away from the leg in similar fashion to the handle. The support includes an inner member and an outer member. The inner member is coupled to the first arm of the fitting, and the outer member is disposed partially over the inner member. In the illustrated embodiment, the outer member and the inner member of the support are provided with a tubular construction. However, other constructions (e.g., constructions with generally square shaped cross sections, constructions with generally oval-shaped cross sections, etc.) could be used for the outer member and/or the inner member within the scope of the present disclosure.

With additional reference to FIG. 3, a pad is provided to cover the support (e.g., fit generally over the outer member of the support, etc.) to improve comfort, support, etc. when resting a forearm on the support. The illustrated pad is configured to receive and support a substantially entire length of the forearm portion of the user's arm. The pad is formed from a foam or gel material and has a generally tubular shape configured to wrap around the support. However, the pad may be shaped differently than illustrated in FIG. 3 and/or may be formed from materials other than foam or gel within the scope of the present disclosure.

The outer member of the support is moveable relative to (e.g., slidable within, etc.) the inner member to allow for changing a length of the support. A locking system is provided to hold, retain, etc. the outer member in a desired position relative to the inner member (and thereby secure the support at a desired length). In particular, the inner member includes a spring-loaded pin configured to selectively position in one of a series of openings defined along the outer member. A spring (not visible) associated with the pin operates to hold the pin in the selected opening. When desired to change a length of the support, the pin can be pressed radially inwardly against a bias of the spring and moved out of the current opening (and out of alignment with the series of openings), and the outer member can then be moved relative to the inner member to a new position. Once the outer member is at the desired position, the pin can be repositioned to align with the new opening corresponding to the new length of the support, and the bias force of the spring then moves the pin into the opening (to thereby secure the outer member relative to the inner member). As such, the support can be adjusted to any one of multiple different lengths as desired. It should be appreciated that locking systems utilizing, for example, friction fittings, compression fittings, etc. could alternatively be used in the mobility aid (instead of spring loaded pins) within the scope of the present disclosure to hold, retain, etc. the outer member of the support in a desired position relative to the inner member of the support.

In the illustrated embodiment, the support extends away from the leg at an angle of about forty-five degrees relative to a longitudinal axis of the leg. In other example embodiments, mobility aids may include supports extending away from legs at angles (relative to longitudinal axes of the legs) ranging between about fifteen degrees and about forty-five degrees. In still other example embodiments, mobility aids may include supports extending away from legs (relative to longitudinal axes of the legs) at angles of less than about forty-five degrees, or at angles greater than about forty-five degrees.

Also in the illustrated embodiment, the leg, the handle, and the support of the mobility aid are generally disposed within a common plane (FIG. 2). And, an angle between the handle and the support is about ninety degrees (e.g., to provide an ergonomic arrangement to help inhibit stress on user's wrists when using the mobility aid, etc.). In other example embodiments, mobility aids may include handles and supports oriented such that angles therebetween range anywhere from about thirty degrees to about ninety degrees. In still other example embodiments, mobility aids may include handles and supports oriented such that angles therebetween are less than about thirty degrees, or are greater than about ninety degrees.

With still continued reference to FIGS. 1 and 2, the force distribution member of the illustrated mobility aid is disposed toward an upper end portion of the support (e.g., toward a proximal end portion of the mobility aid, etc.). The force distribution member includes an arm and an arcuate brace. The brace is coupled to the arm as desired, and the arm is coupled to the support by a pivotal joint (e.g., a ball and socket joint, etc.). The pivotal joint allows for independent motion (e.g., rotational movement, etc.) of the force distribution member relative to the support (and the handle and leg). Further, the pivotal joint (e.g., ball and socket joint, etc.) allows for relative movement of the handle and leg portion of the support relative to the body of the user, allowing the mobility aid to be more easily moved from back to front (and vice versa) during use. In addition, the force distribution member can be moved, as needed, to accommodate different sized users. Moreover, the force distribution member can be moved, as needed, to accommodate use of the mobility aid on either a left side or a right side of the user. For example, the illustrated force distribution member can be rotated, pivoted, etc. about a longitudinal axis of the support (e.g., at least about one-hundred eighty degrees, rotational amounts less than one-hundred eighty degrees, etc.) such that the force distribution member can be positioned on either side of the support.

A pad is provided to cover (e.g., fit over, couple to (e.g., via fasteners, adhesive, etc.), etc.) the brace of the force distribution member to improve comfort, support, etc. In the illustrated embodiment, the pad is formed from a foam or gel material and has a generally contoured shape matching a side portion of a user's body. And, end portions of the pad are configured to couple to (e.g., via fasteners, adhesive, etc.) corresponding end portions of the brace. With that said, the pad may be shaped differently than illustrated herein and/or may be formed from materials other than foam or gel within the scope of the present disclosure.

General use of the mobility aid will be described next. A user initially adjusts the mobility aid to fit their body. This includes adjusting the length of the leg to fit the user's height, and the length of the support (e.g., by adjusting a ball and socket joint such as that described above) to provide a comfortable fit for the user's arm (such that the user's arm comfortably rests on the support and the user can comfortably grasp the handle). Next, the user places the tip of the leg on a desired surface with the leg oriented generally vertically, and positions the force distribution member along (e.g., in contact with, etc.) a side portion of user's body (e.g., at approximately elbow height, etc.). Then, the user rests their forearm on the support in position to grasp the handle. In this position, the force distribution piece operates to help align the mobility aid with the user's body and to help support, brace, etc. the user (e.g., while standing, walking, etc.). If needed, the above process can be repeated for a second mobility aid so that a mobility aid can be positioned on both a left side and a right side of the user's body. The user can now rest on the mobility aids (when two of the mobility aids are used) and transfer at least part of their lower body weight to the mobility aids. To move, the user lifts their legs, balances on their forearms, and swings their legs forward of the mobility aids. The user then balances on one or both of their legs and moves the mobility aids forward to a location generally ahead of the user. If the support is attached to the leg using a ball and socket joint as described above, the joint will rotate to assist in moving the mobility aids forward. This process is then repeated for continued movement (e.g., continued walking, etc.). Optionally, for partial weight bearing, the mobility aid on the right is advanced with partial weight bearing on the left leg and/or the mobility aid on the left is advanced with partial weight bearing on the right leg for reciprocal walking using a pair of mobility aids.

As can be seen, the mobility aid of the present disclosure provides advantages, benefits, etc. over currently available aids (e.g., currently available under-arm crutches, etc.). For example, the mobility aid of the present disclosure is adjustable to accommodate different sized users. The length of the leg of the mobility aid can be adjusted to accommodate users having different heights. The support of the mobility aid can also be adjusted to accommodate users having different lengths of arms. The mobility aid also allows for orienting (e.g., angling, etc.) users' hands above a horizontal axis which creates a more ergonomic handhold (as opposed to currently available aids). This, in turn, helps reduce risks of incurring radial, median and/or ulnar nerve damage when using the mobility aid, as the weight bearing forces directed toward the user's wrist(s) occur at a more natural angle. In addition, the support of the mobility aid provides increased surface area contact with user's forearm(s) to help reduce fatigue during use. For example, the increased surface area of the support operates to help distribute forces associated with user's weight more uniformly along entire lengths of their forearm(s). The support also changes the resting position (e.g., the standing position, etc.) for the mobility aid from a position with pressure points under the arms (as in various currently available aids) to a position where weight is distributed along a length of the support. Further, the force distribution member of the mobility aid helps inhibit axillary nerve damage by providing improved weight distribution (as opposed to various currently available aids). This reduces pressure at each point of contact (e.g., under arms, on hands, etc.), which lowers the risk of compression nerve injury.

Figure 4:
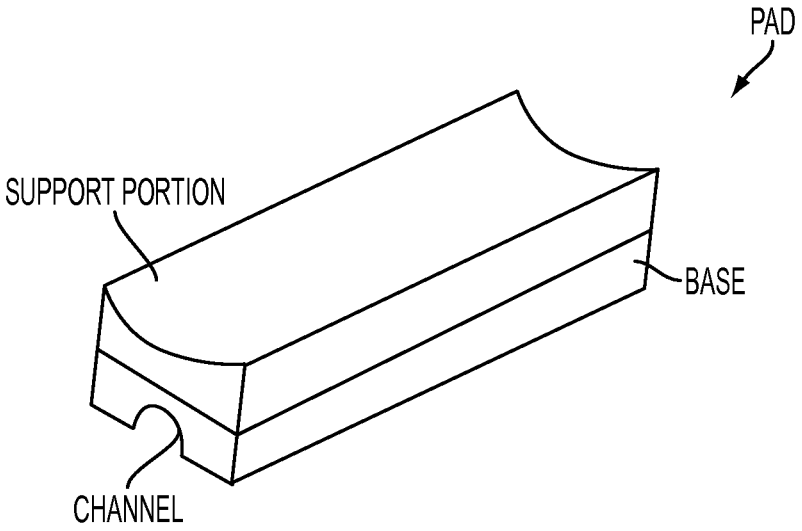
FIG. 4 is a perspective view of an example embodiment of another pad for use with a support of a mobility aid of the present disclosure.
Figure 5:
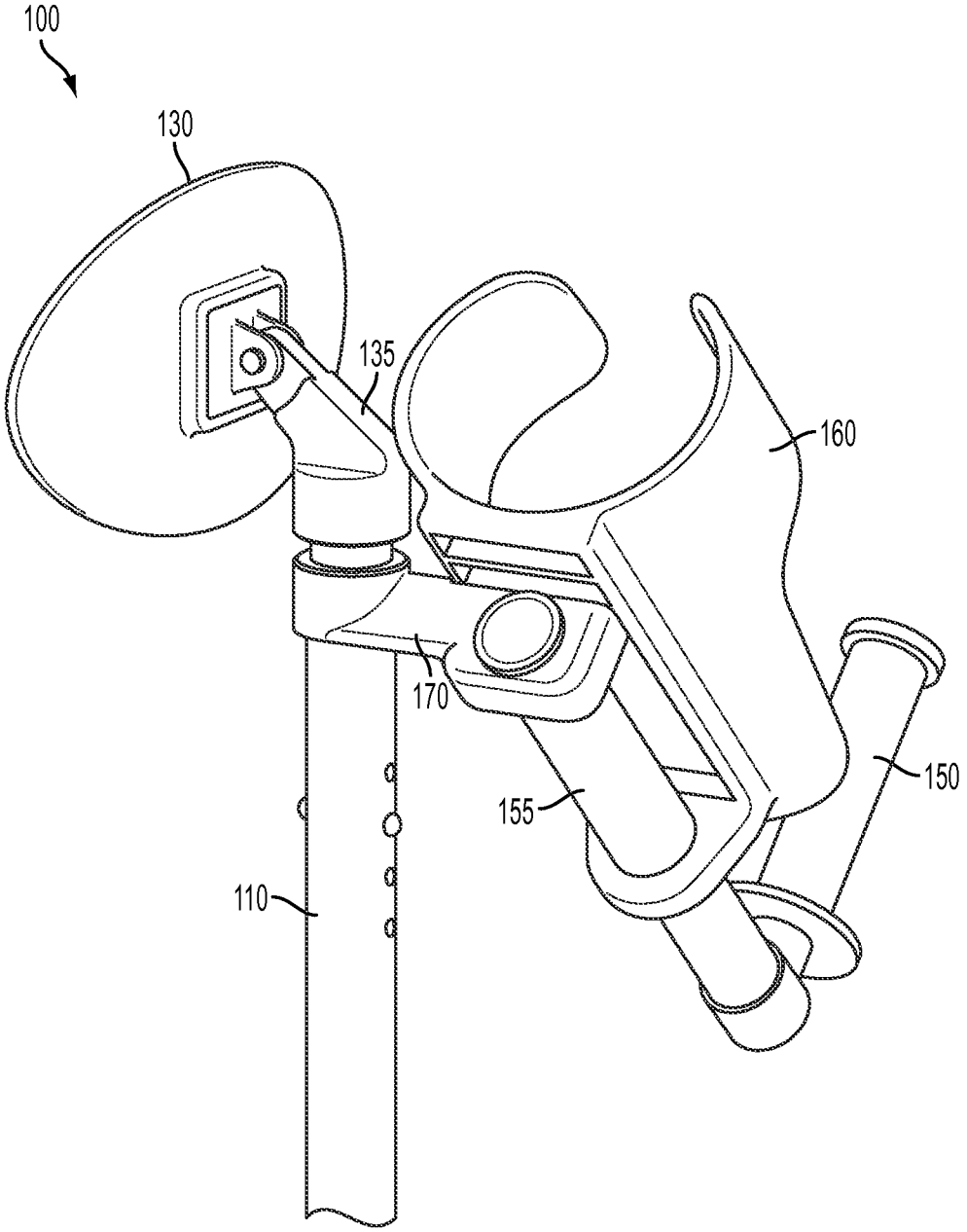
FIG. 5 is a partial side perspective view of a mobility aid having a leg, a force distribution member for engaging a user's side and an arm support including a handle in which the arm support is offset from the plane in which the leg is located.
Figure 6:
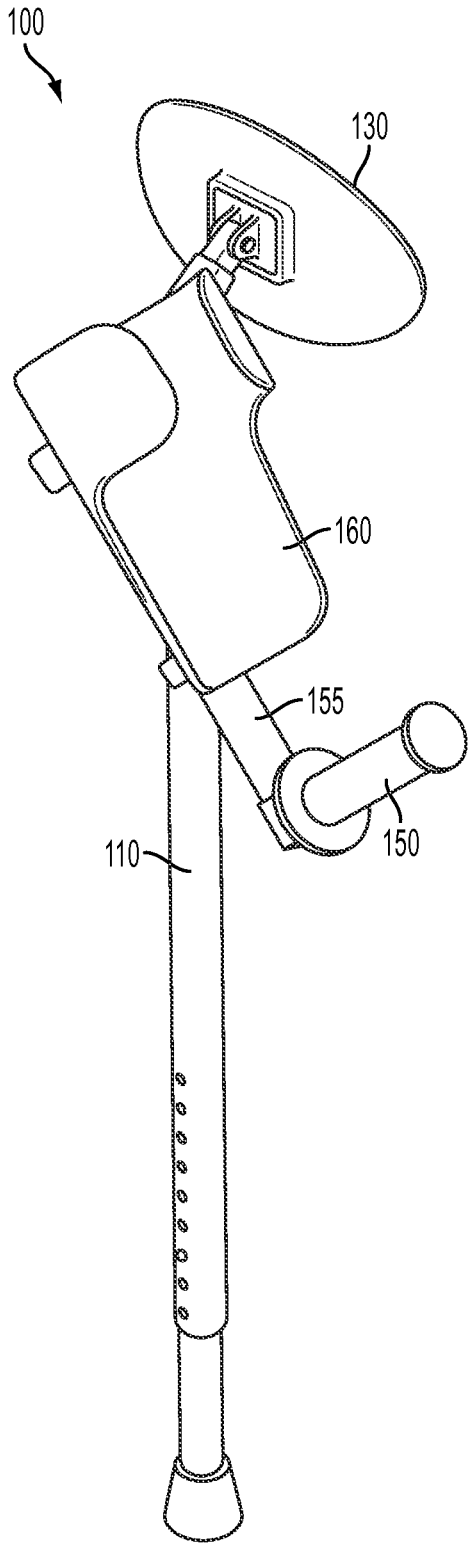
FIG. 6 is a top perspective view of the mobility aid of FIG. 5.
Figure 7:
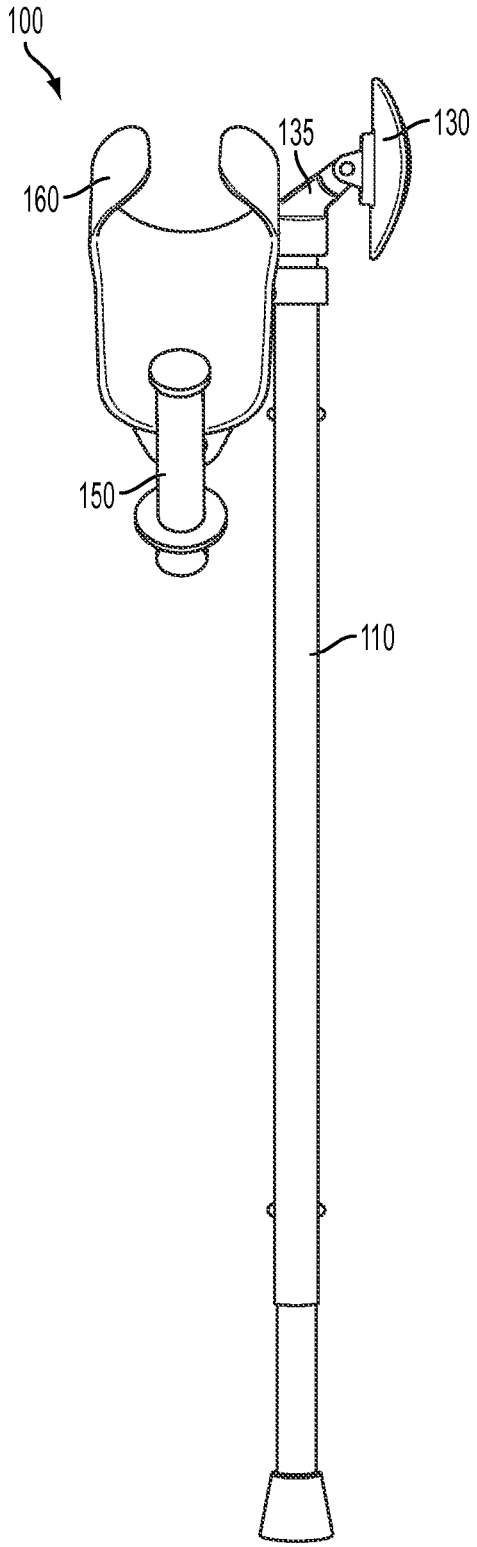
FIG. 7 is a front view of the mobility aid of FIG. 5.
Figure 8:
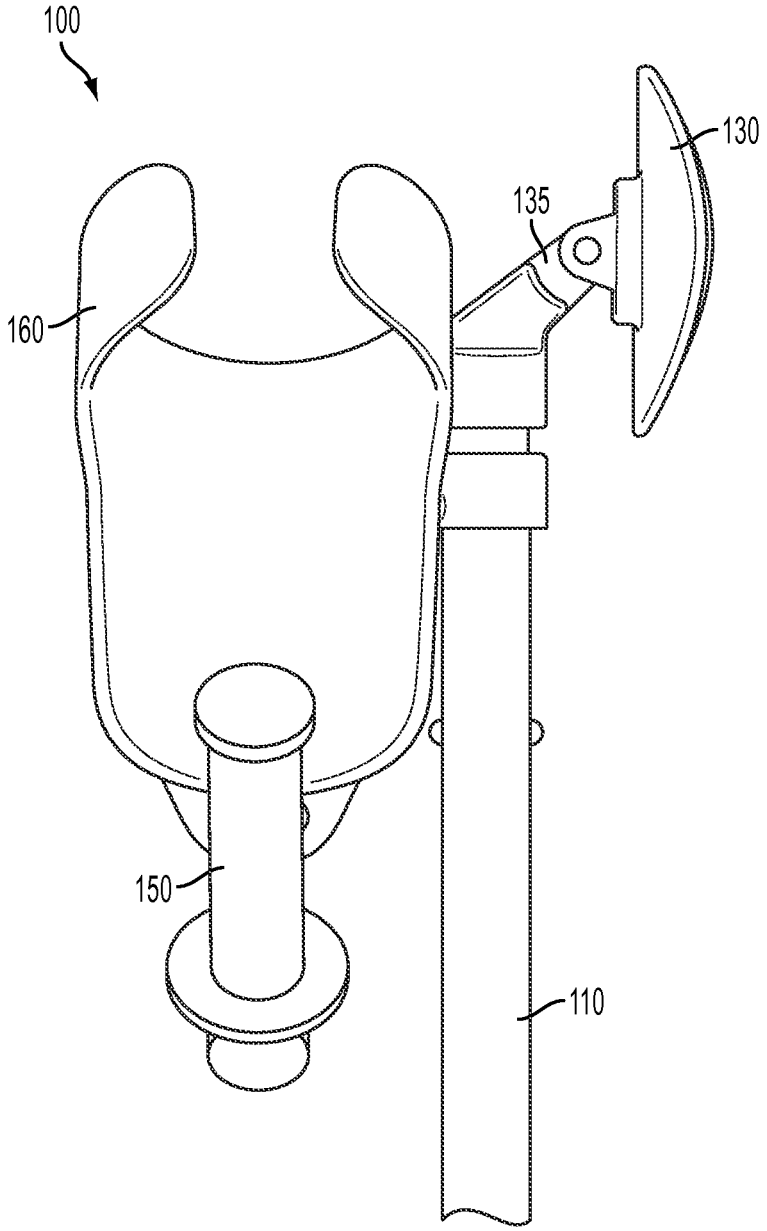
FIG. 8 is a partial front view of the mobility aid of FIG. 5.
Figure 9:
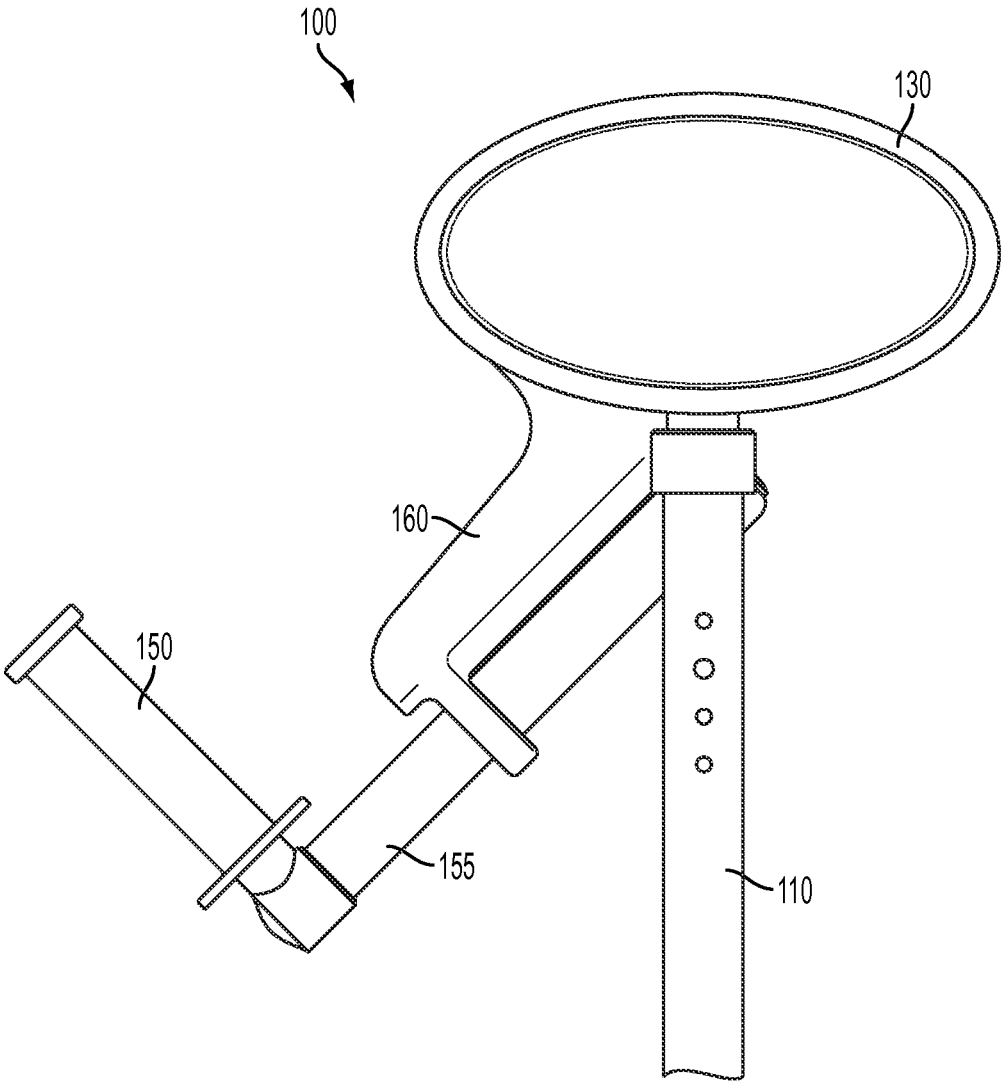
FIG. 9 is a partial side view of the mobility aid of FIG. 5.
Figure 10:
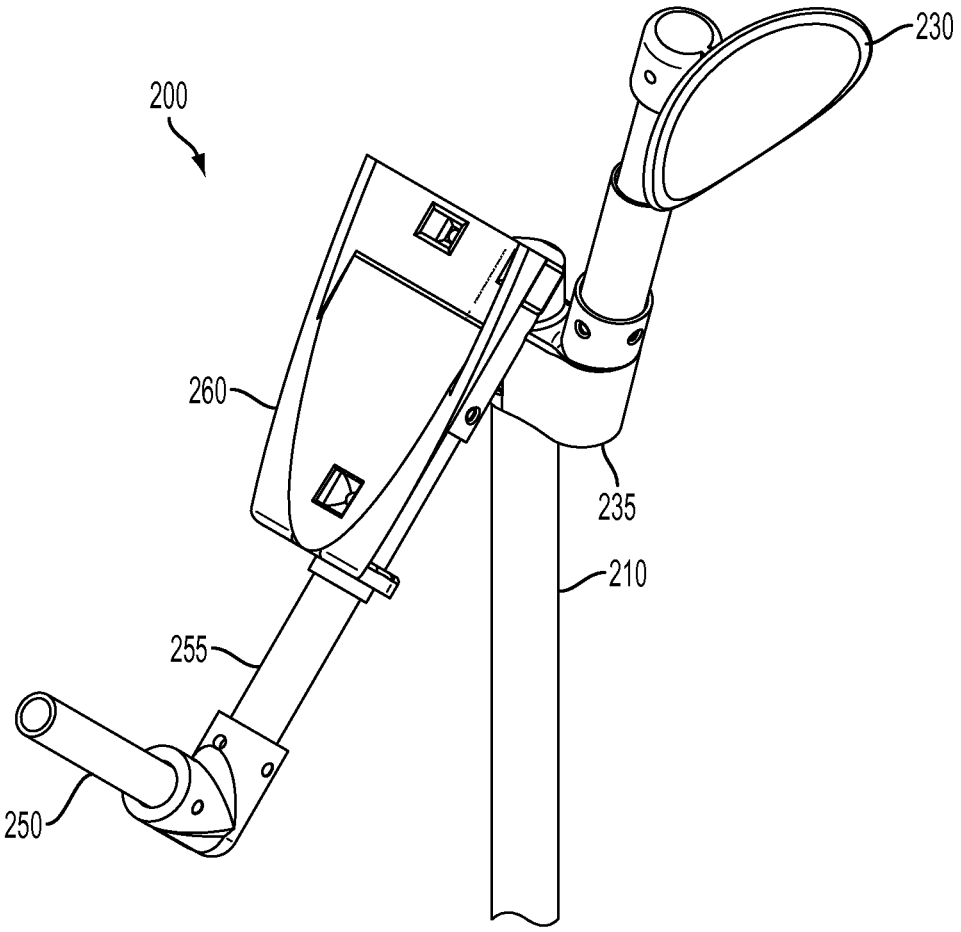
FIG. 10 is a is a partial side perspective view of a mobility aid having a leg, a force distribution member for engaging a user's side and an arm support including a handle in which the leg, arm support and handle are generally coplanar.
Figure 11:
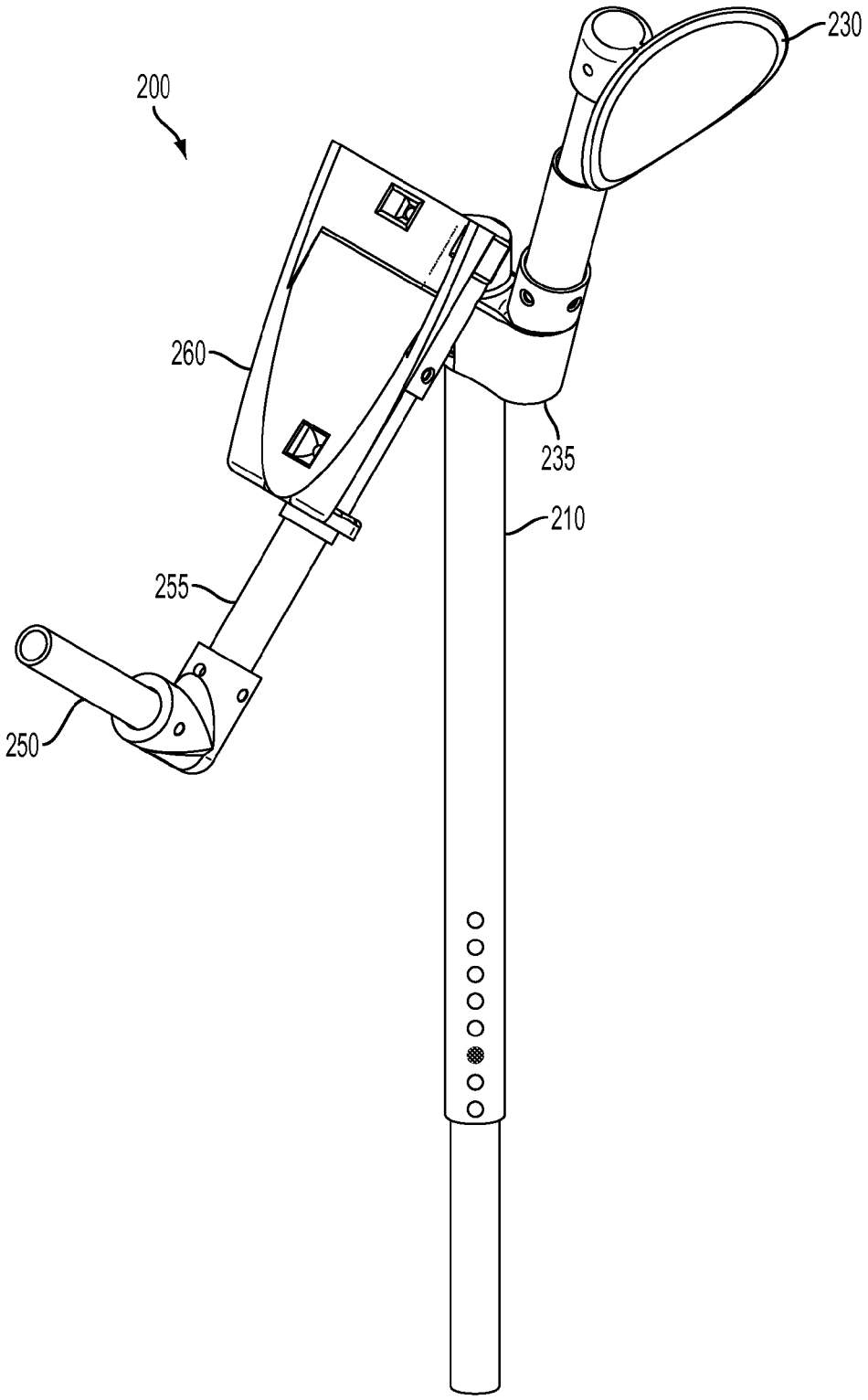
FIG. 11 is a is a top perspective view of the mobility aid of FIG. 10.
Figure 12:
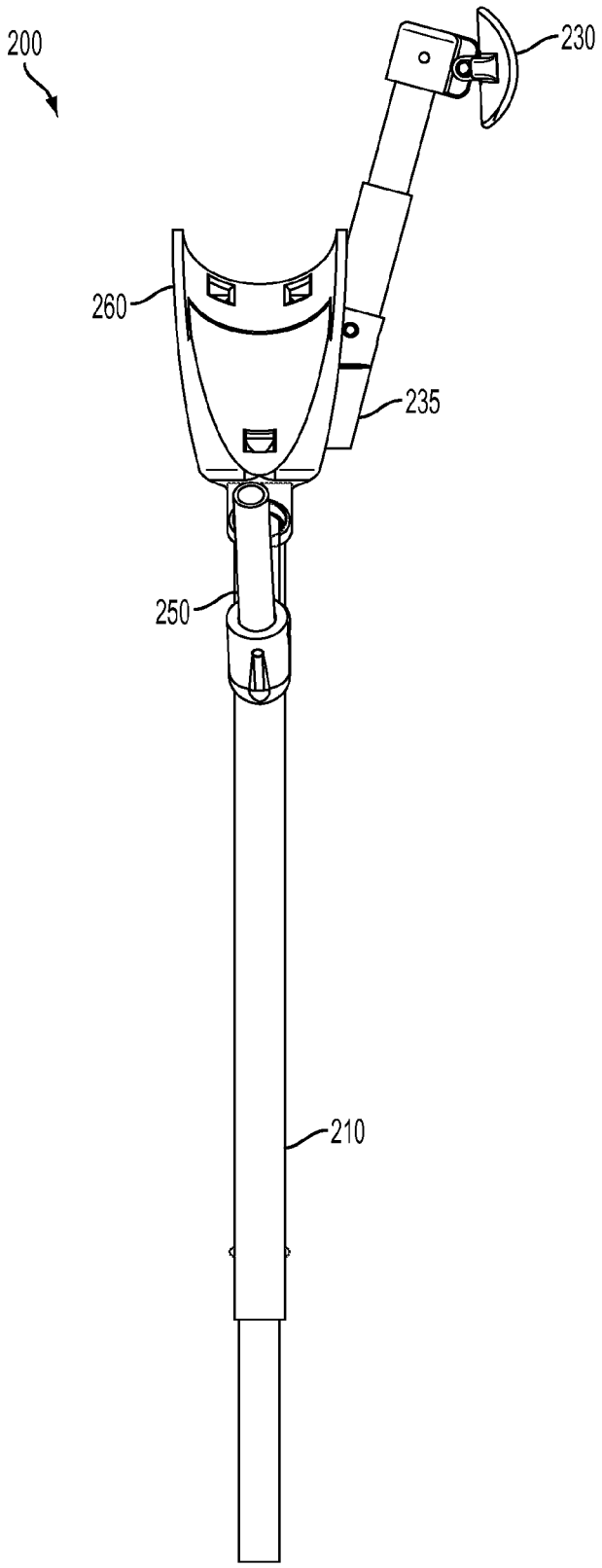
FIG. 12 is a front view of the mobility aid of FIG. 10.
Figure 13:
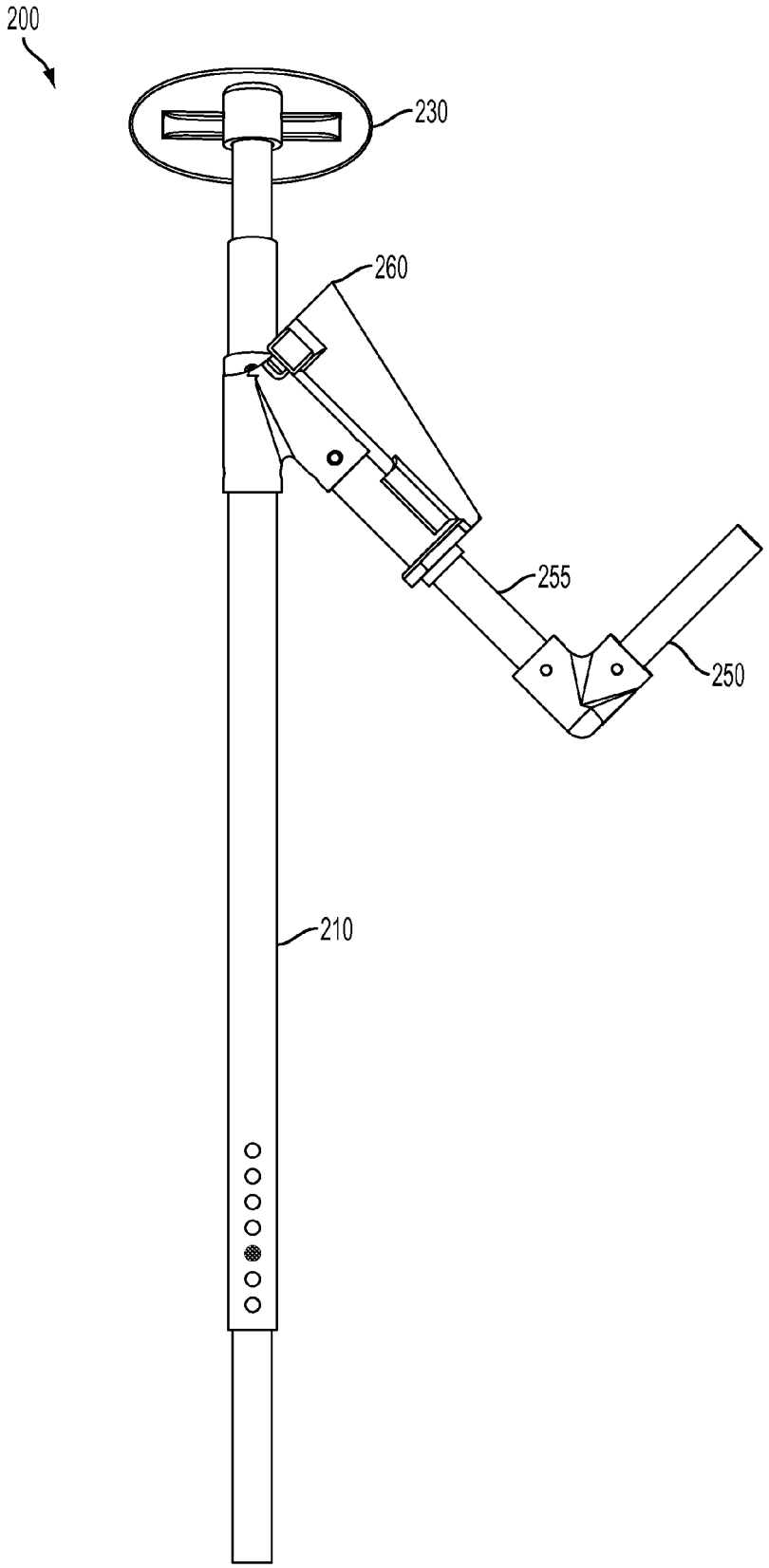
FIG. 13 is a side view of the mobility aid of FIG. 10.
Figure 14:
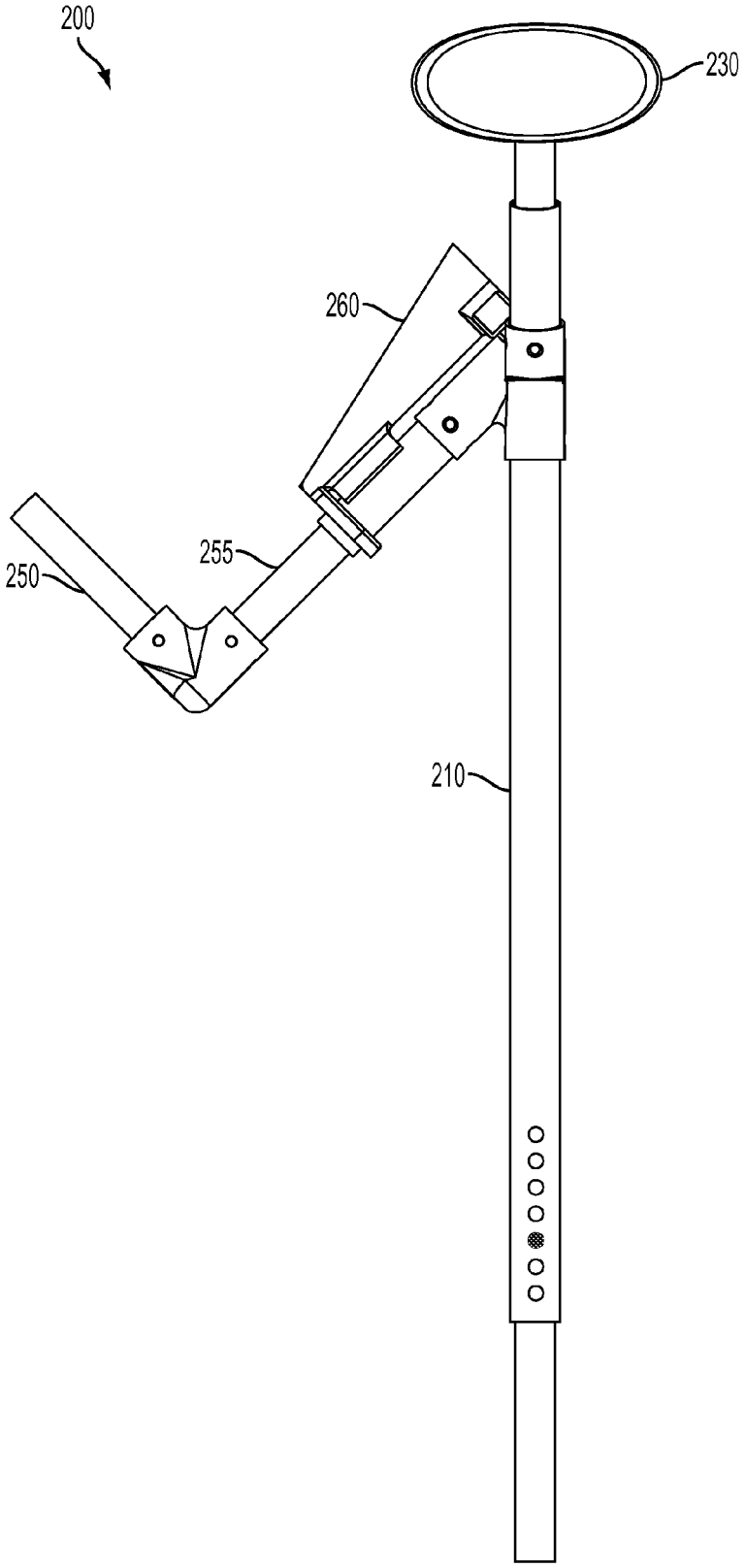
FIG. 14 is another side view of the mobility aid of FIG. 10.
Figure 15:
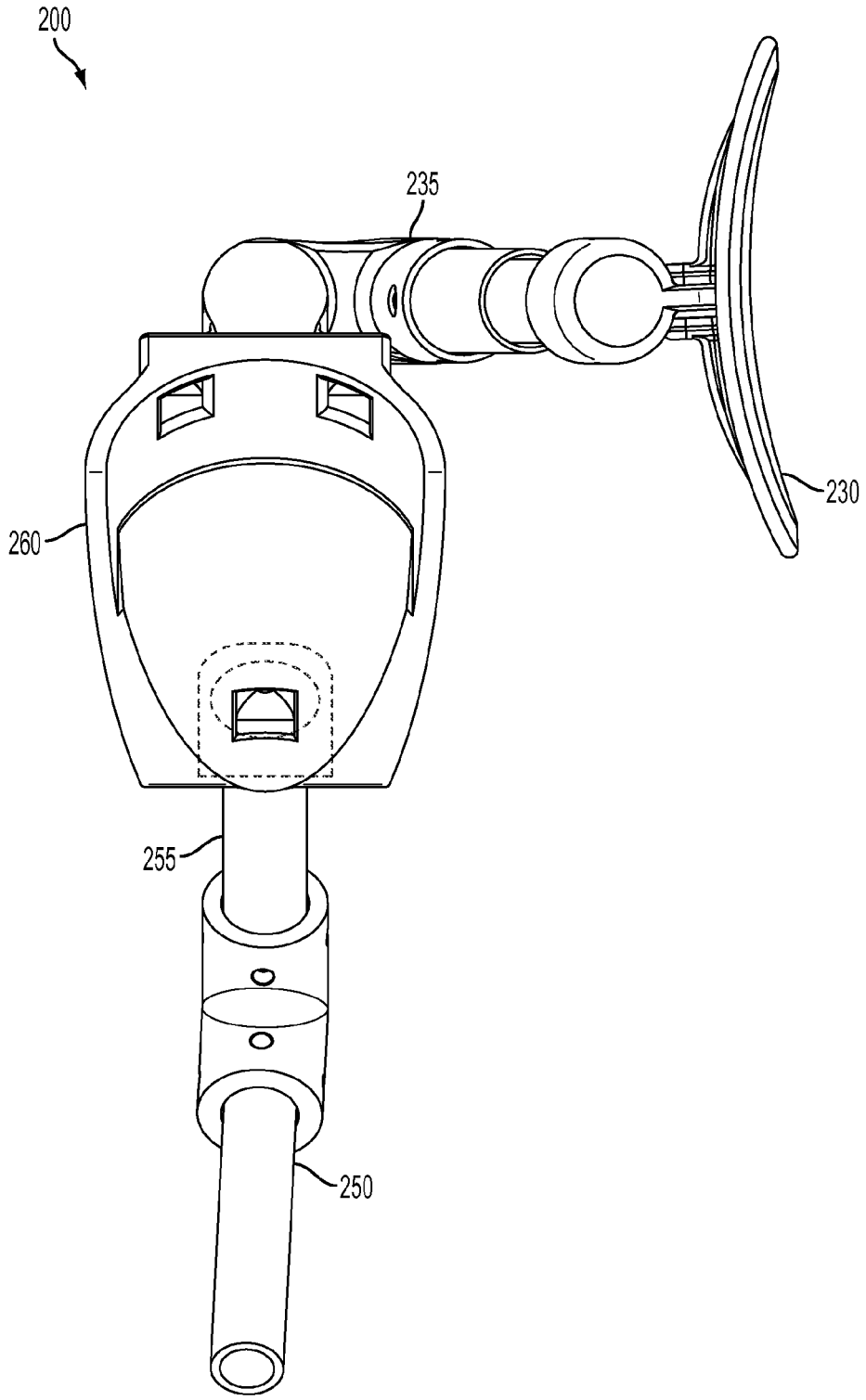
FIG. 15 is a top view of the mobility aid of FIG. 10.

FIG. 4 illustrates an example embodiment of an alternative pad (e.g., a support cuff, etc.) for use with a support of a mobility aid (e.g., with the support of the mobility aid previously described and illustrated in FIGS. 1-3, etc.). The pad includes a support portion and a base. The pad is configured to couple to an upper side of the support of the mobility aid via a channel defined in the base (e.g., using mechanical fasteners, adhesive, etc.). The support portion includes an arcuate upper surface (e.g., a surface that defines a round portion that is less than about 180 degrees of a full circle of its radius of curvature, etc.), and that can be made from any suitable material (e.g., foam, gel, etc.). The support portion thereby defines a cradle for generally comfortably supporting a user's forearm when using the mobility aid and/or for helping secure the user's forearm therein (e.g., against sliding off the pad, etc.).

In other example embodiments, mobility aids generally include legs, handles, and supports coupled together using adjustable fittings. For example, the fittings may include arms for receiving the legs, handles, and supports where rotational angles between the arms can be changed. As such, in these embodiments users can adjust angles between the handles and the legs and/or angles between the supports and the legs and/or angles between the handles and the supports. For example, such an adjustable fitting could be used in place of the fitting in the mobility aid illustrated in FIGS. 1 and 2. With that said, it should be appreciated that any suitable adjustment mechanisms can be used in the adjustable fittings such as, for example, spring-loaded pin mechanisms that can lock at various angles, etc.

In other example embodiments, mobility aids may include legs, handles, and supports formed as single pieces of material (e.g., formed monolithically, formed without requiring fittings to couple them together, etc.) and into desired configurations (e.g., generally Y shapes, etc.). In other example embodiments, mobility aids may include legs, handles, and supports, where the legs, handles, and/or supports are welded together in desired configurations (e.g., generally Y shapes, etc.). In still other example embodiments, mobility aids may include legs, handles, and supports, where the legs and handles, or the legs and supports, or the handles and supports are formed as single pieces of materials (or are welded together) and the third components (e.g., the supports, the handles, or the legs, etc.) are separately coupled thereto (e.g., via fittings, welding, adhesive, etc.) to provide desired configurations (e.g., generally Y shapes, etc.) for the mobility aids.

In other example embodiments, mobility aids may include legs having inner members and outer members disposed at least partly around the inner members, where the inner members are coupled to fittings (along with handles and supports) and the outer members are moveable relative to the inner members to allow for adjusting lengths of the legs (and sizes of the mobility aids). In other example embodiments, mobility aids may include supports having inner members and outer members disposed at least partly around the inner members, where the outer members are coupled to fittings (along with handles and legs) and the inner members are moveable relative to the outer members to allow for adjusting lengths of the supports.

In other example embodiments, mobility aids may include force distribution members comprising spans of netting or mesh-like material for contacting side portions of users' bodies (to thereby help provide support and stability to the users).

FIGS. 5-9 illustrate a further exemplary mobility aid 100 according to the present disclosure. The mobility aid 100 includes a leg 110, force distribution member 130 and a handle 150 similar to those described herein. The force distribution member 130 is offset from the leg 110 by a force distribution member support 135, which locates the force distribution member away from the leg 110 and towards the user's body to engage a portion of the user's body. The handle 150 is located on an arm support 155. In this mobility aid 100, the handle 150 and arm support 155 are offset 170 from the leg 110 such that the leg 110, handle 150 and arm support 155 do not lie in a common plane.

The mobility aid 100 illustrated in FIGS. 5-9 also includes a cuff 160 located on the arm support 155 which may support the forearm of the user and keep the mobility aid 100 close to the user's forearm during use.

FIGS. 10-15 illustrate yet a further exemplary mobility aid 200 according to the present disclosure. The mobility aid 200 includes a leg 210, force distribution member 230 and a handle 250 similar to those described herein. The force distribution member 230 is offset from the leg 210 by a force distribution member support 235, which locates the force distribution member away from the leg 210 and towards the user's body to engage a portion of the user's body. The handle 250 is located on an arm support 255. In this mobility aid 200, the handle 250 and arm support 255 are located on a common plane with the leg 210; i.e., they are not offset from the leg 210 as with the mobility aid 100 illustrated in FIGS. 5-9 described above. This mobility aid 200 includes a cuff 260 located on the arm support 255 which may support the forearm of the user and keep the mobility aid 200 close to the user's forearm during use.

While FIGS. 5-9 illustrate a particular type of cuff 160 that wraps around the forearm of the user over 180 degrees and FIGS. 10-15 illustrate another type of cuff 260 that wraps around the forearm of the user substantially less than 180 degrees, it will be recognized that other types of cuffs are known and could be used; for example the cuff could completely encircle the forearm of the user (such that the user inserts his/her forearm through the cuff prior to use), or in which the cuff is secured to the user with straps or another fastener.

The mobility aids 100, 200 illustrated in FIGS. 5-15 and described above may include other features illustrated in FIGS. 1-4 and included in the associated description. For example, the length of the leg 110, 210 may be adjustable to accommodate users of different heights. The length of the arm support 155, 255 may also be adjustable to accommodate users having forearms of differing lengths. Similarly, the length of the force distribution member support 135, 235 may also be adjustable, and the length of the offset 170 may also be, but does not have to be, adjustable. While not shown in these figures, the relative angles between the leg 110, 210 and the arm support 155, 255 and the force distribution member support 135, 235 and leg 110, 210 may also be adjustable according to known methods to accommodate different sizes and dimensions of users.

Specific dimensions (e.g., length dimensions, angular dimensions, etc.) included herein are exemplary in nature and do not limit the scope of the present disclosure.

Example embodiments are provided so that this disclosure will be thorough, and will fully convey the scope to those who are skilled in the art. Numerous specific details are set forth such as examples of specific components, aids, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known aid structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the aid in use or operation in addition to the orientation depicted in the figures. For example, if the aid in the figures is turned over, elements described as "below" or "beneath" other elements or features would then be oriented "above" the other elements or features. Thus, the example term "below" can encompass both an orientation of above and below. The aid may be otherwise oriented (rotated 90 degrees or at other orientations) and the spatially relative descriptors used herein interpreted accordingly.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A mobility aid for use in supporting at least part of a user's body weight, the mobility aid comprising:

a leg having a longitudinal axis;

an arm support supported by the leg at an angle relative to the longitudinal axis of the leg of between about fifteen degrees and about forty-five degrees for directly receiving at least part of a forearm portion of a user's arm and for supporting a portion of a user's weight through the at least part of the forearm portion of the user's arm during use of the mobility aid, wherein the arm support and the longitudinal axis of the leg lie in a common plane;

a handle located on the arm support and within the common plane, the handle positioned to be graspable by a hand of the user's arm during use of the mobility aid, wherein the handle is positioned at an angle with the arm support greater than thirty degrees; and a force distribution member coupled to the leg by a force distribution member support and offset from the leg by a distance, the force distribution member forming an angle with the longitudinal axis of the leg of between about fifteen degrees and about forty-five degrees, wherein the force distribution member engages a user's side during use of the mobility aid to facilitate alignment of the leg of the mobility aid at an outward angle from a user's body when the user's weight is supported by the arm support during use of the mobility aid, and wherein the force distribution member is linearly adjustable with respect to the leg to position the force distribution member against the user's side at approximately elbow height and spaced below an axillar region of the user during use of the mobility aid.

2. The mobility aid of claim 1, wherein the leg includes an inner member and an outer member, the inner member being moveable relative to the outer member to thereby allow for adjustment of a length of the leg.

3. The mobility aid of claim 1, wherein the arm support includes an inner member and an outer member, the outer member being moveable relative to the inner member to thereby allow for adjustment of a length of the arm support.

4. The mobility aid of claim 1, wherein the arm support incudes a cuff configured to receive and support substantially an entire length of the forearm portion of the user's arm.

5. The mobility aid of claim 1, wherein the arm support is adjustable relative to the leg to allow for changing a rotational angle between the arm support and the leg.

6. The mobility aid of claim 1, wherein the force distribution member support is adjustable relative to the leg to allow for changing a rotational angle between the force distribution member support and the leg.

7. The mobility aid of claim 1, wherein the force distribution member support comprises an arm coupling the force distribution member to the arm support.

8. The mobility aid of claim 1, wherein the force distribution member is coupled to the leg by a force distribution member support coupled directly to the leg.

* * * * *